US007644921B2

(12) United States Patent
Hattori

(10) Patent No.: US 7,644,921 B2
(45) Date of Patent: Jan. 12, 2010

(54) IMAGE FORMING APPARATUS

(75) Inventor: Yoshiteru Hattori, Ichinomiya (JP)

(73) Assignee: Brother Kogyo Kabushiki Kaisha, Nagoya-shi, Aichi (JP)

( * ) Notice: Subject to any disclaimer, the term of this patent is extended or adjusted under 35 U.S.C. 154(b) by 207 days.

(21) Appl. No.: 11/845,565

(22) Filed: Aug. 27, 2007

(65) Prior Publication Data

US 2008/0219732 A1 Sep. 11, 2008

(30) Foreign Application Priority Data

Aug. 29, 2006 (JP) ..... 2006-232148

(51) Int. Cl.
*B65H 7/02* (2006.01)

(52) U.S. Cl. ..... 271/265.01; 271/110

(58) Field of Classification Search ..... 271/258.01, 271/265.01, 265.02, 110
See application file for complete search history.

(56) References Cited

U.S. PATENT DOCUMENTS

| | | | | |
|---|---|---|---|---|
| 5,042,790 | A * | 8/1991 | Miller et al. | 271/110 |
| 5,882,130 | A * | 3/1999 | Kumazaki et al. | 400/642 |
| 6,151,458 | A * | 11/2000 | Sato et al. | 399/16 |
| 6,215,965 | B1 * | 4/2001 | Sato | 399/16 |
| 6,247,695 | B1 * | 6/2001 | Linder et al. | 271/265.04 |
| 7,131,782 | B2 | 11/2006 | Jung | |
| 7,404,558 | B2 * | 7/2008 | Kanome | 271/258.05 |
| 2004/0028450 | A1 | 2/2004 | Jung | |
| 2004/0041329 | A1 | 3/2004 | Hiraoka | |

FOREIGN PATENT DOCUMENTS

| | | |
|---|---|---|
| CN | 1257804 A | 5/2006 |
| JP | 54065969 | 5/1979 |
| JP | 63-286860 A | 11/1988 |
| JP | 5155464 | 6/1993 |
| JP | 06127740 | 5/1994 |
| JP | 7133038 | 5/1995 |
| JP | 8259037 | 10/1996 |
| JP | 10074015 | 3/1998 |
| JP | 2004083234 | 3/2004 |

OTHER PUBLICATIONS

CN Office Action dtd May 8, 2009, CN Appln. 2007101482054, English Translation.

* cited by examiner

*Primary Examiner*—Kaitlin S Joerger
(74) *Attorney, Agent, or Firm*—Banner & Witcoff, Ltd.

(57) ABSTRACT

An image forming apparatus in accordance with the present invention can include a conveying device capable of conveying a recording medium, a support shaft which capable of being movably supported between a medium sensing position near a conveyance path along which the conveying device conveys the recording medium and a retracting position kept away from the medium sensing position, wherein the support shaft is biased to the medium sensing position, a medium sensing member connected to the support shaft and is capable of rotating between a standby position wherein a portion of the support shaft is inside the conveyance path and a detection position wherein a portion of the support shaft is removed from the conveyance path by the recording medium passing along the conveyance path when the support shaft is in the medium sensing position, and a rotation detection device capable of detecting a rotary displacement of the medium sensing member.

18 Claims, 9 Drawing Sheets

IMAGE FORMING APPARATUS

CROSS REFERENCE TO RELATED APPLICATION

This application claims priority from Japanese Patent Application No. 2006-232148 filed Aug. 29, 2006. The entire content of this/these priority application(s) is incorporated herein by reference.

TECHNICAL FIELD

The present disclosure relates to an image forming apparatus.

BACKGROUND

Conventionally, an image forming apparatus has included an actuator for detecting a recording medium. The configuration includes a sensing arm, part of which is located in a conveyance path of a recording medium, and which detects the recording medium by the rotation of the sensing arm according to the conveyance of the recording medium.

The aforementioned actuator detects a recording medium by a sensing arm. The sensing arm needs to be pushed and rotated by a conveyed recording medium. Immediately after the recording medium has passed, the sensing arm needs to be brought to a position in which another recording medium is expected to pass. In addition, the recording medium may be fed backward by users for jam processing. Therefore, it is preferable that the recording medium not be easily interfered with by a sensing lever, and a jammed recording medium be easily removable.

In view of this problem, the conventional technology provides a configuration of a sensing arm including a main arm and an auxiliary arm which is coupled to the main arm and can be rotated only in one direction. In this configuration, the main and auxiliary arms are rotated in a forward direction during normal conveyance. However, when a recording medium is fed backward, only the auxiliary arm is rotated backward to allow the recording medium to be removed. This configuration has a disadvantage in that the sensing arm needs to be formed of a plurality of components, thereby increasing the number of components, the cost, and complicating the structure of the sensing arm itself.

Therefore, there is a need in the art for a sensing arm with a simple configuration in which a recording medium cannot be easily interfered with a sensing arm even when the recording medium is fed backward.

SUMMARY

An image forming apparatus in accordance with the present invention can include a conveying device configured to convey a recording medium, a support shaft which is configured to be movably supported between a medium sensing position near a conveyance path along which the conveying device conveys the recording medium and a retracting position kept away from the medium sensing position, wherein the support shaft is biased to the medium sensing position, a medium sensing member connected to the support shaft and is configured to rotate between a standby position wherein a portion of the support shaft is inside the conveyance path and a detection position wherein a portion of the support shaft is removed from the conveyance path by the recording medium passing along the conveyance path when the support shaft is in the medium sensing position, and a rotation detection device configured to detect a rotary displacement of the medium sensing member.

BRIEF DESCRIPTION OF THE DRAWINGS

Illustrative aspects in accordance with the invention will be described in detail with reference to the following figures wherein.

DETAILED DESCRIPTION OF THE PREFERRED ILLUSTRATIVE ASPECTS

An illustrative aspect of the present invention will be described in detail with reference to the drawings.

1. Entire Configuration of Laser Printer

Figure 1:
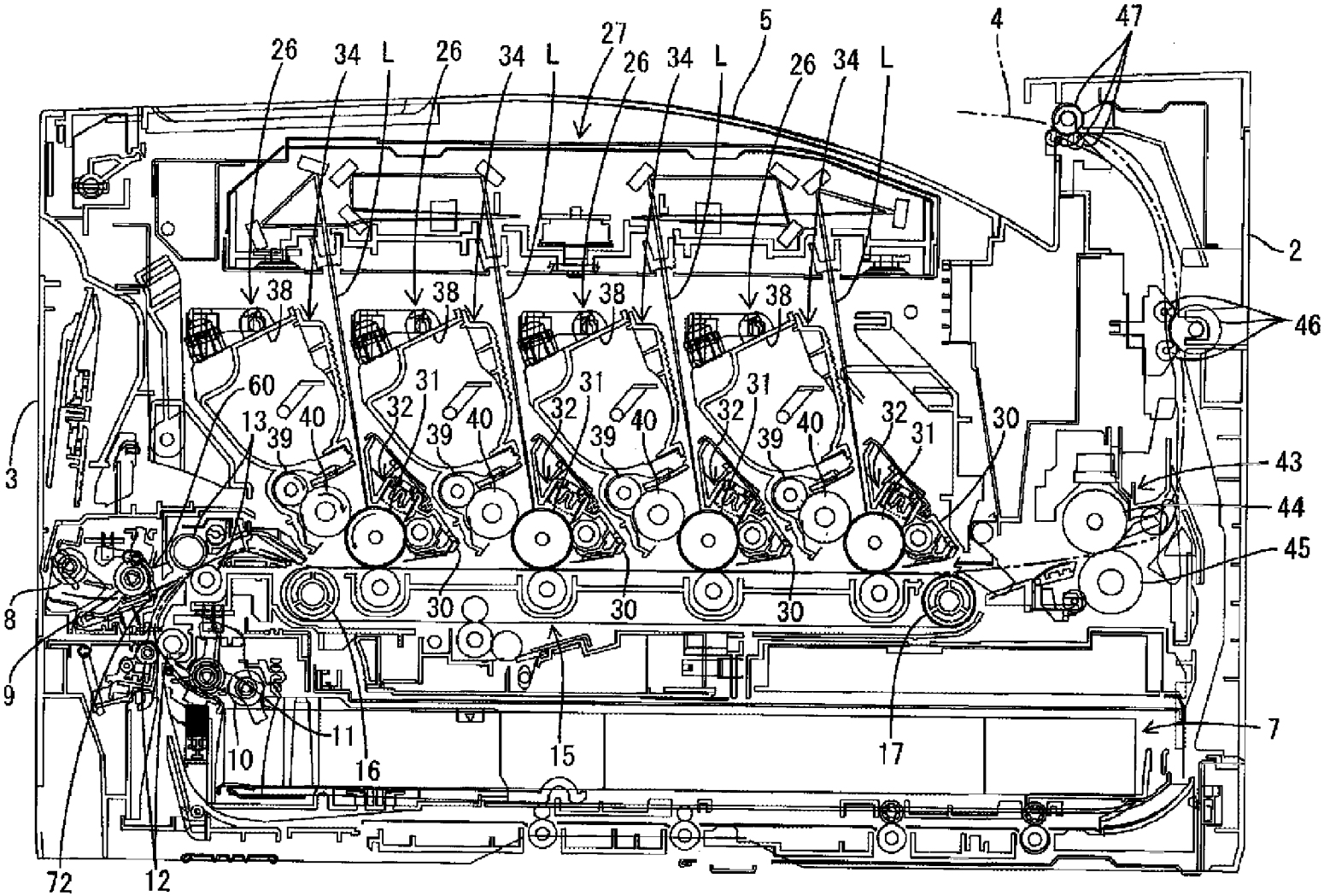
FIG. 1 is a schematic side sectional view illustrating a laser printer in accordance with a first illustrative aspect of the present invention.

FIG. 1 is a partially schematic side sectional view showing a schematic configuration of a laser printer 1 in accordance with an illustrative aspect of the present invention. In the following description, the left hand side in FIG. 1 is assumed to be the front of the laser printer 1. This laser printer 1 serves as an image forming apparatus, and more specifically, a direct transfer tandem type color laser printer having an approximately box-like main body casing 2 as shown in FIG. 1. A front cover 3 capable of being opened and closed is located on the front of the main body casing 2. A discharge tray 5 for discharging a recording medium 4 on which an image has been formed is formed on an upper surface of the main body casing 2. A supply tray 7, on which recording medium 4 (for forming an image) are stacked, is inserted into a lower part of the main body casing 2. A recording medium can be made of paper, plastic, or the like.

A recording medium 4 on the supply tray 7 is passed through rollers 10, 11, and 12 onto a resist roller 13. Then, the resist roller 13 passes the recording medium 4 onto a belt unit 15 located backward at a predetermined timing.

In addition, there is provided a conveying roller 8 for conveying a recording medium 4 fed from a manual feed port. This conveying roller 8, which is configured to be driven by a motor (not shown), conveys the recording medium 4 from the manual feed port which is opened when the front cover 3 is opened. The conveying roller 8 and the resist roller 13 constitute a part of a conveying device for conveying a recording medium.

A belt unit 15 is provided with a conveying belt 18 positioned between a pair of support rollers 16 and 17, each roller spaced from each other, one at front and one at back. Of the pair of support rollers 16 and 17, the support roller 17 at back is rotatably driven by a motor (not shown), and the support roller 16 at front is a tension roller (driven roller) for giving a tension to the conveying belt 18 as described later. The conveying belt 18, which can be a belt made of a polycarbonate resin and the like, conveys a recording medium 4 placed on its surface backward (shown at right). Inside the conveying belt 18, four transfer rollers 19 are uniformly spaced from front to rear, each roller facing a photoreceptor drum 31 described later.

Process cartridges 26 are arranged from front to rear and detachably mounted above the belt unit 15. The process cartridges 26 serve as an image forming portion, each cartridge can correspond to a different color (e.g. magenta, yellow, cyan, and black). A scanner portion 27 is located above the image forming portion. The scanner portion 27 irradiates a laser beam L for each color based on a specified image data onto the surface of the corresponding photoreceptor drum 31 by a high-speed scanning.

The process cartridge 26 includes a cartridge frame 30, a photoreceptor drum 31 located under the cartridge frame 30, and a charging device 32 (e.g. of the scorotron type). In addition, there is also provided a developing cartridge 34 which is detachably mounted on the cartridge frame 30. The developing cartridge 34 includes a toner containing chamber 38 for storing toner inside. A supply roller 39, a developing roller 40 and the like are located under the chamber 38.

A recording medium 4 bearing a toner image is conveyed through between a heat roller 44 and a pressure roller 45 for heating and then passed to a fixing device 43 which heat-fixes the toner image on the recording medium 4. The heat-fixed recording medium 4 is passed to a conveying roller 46 arranged obliquely upward and rearward of the fixing device 43, and then passed to a discharge roller 47 arranged in an upper portion of a main body casing 2. The discharge roller 47 discharges the recording medium 4 onto the aforementioned discharge tray 5.

Figure 2:
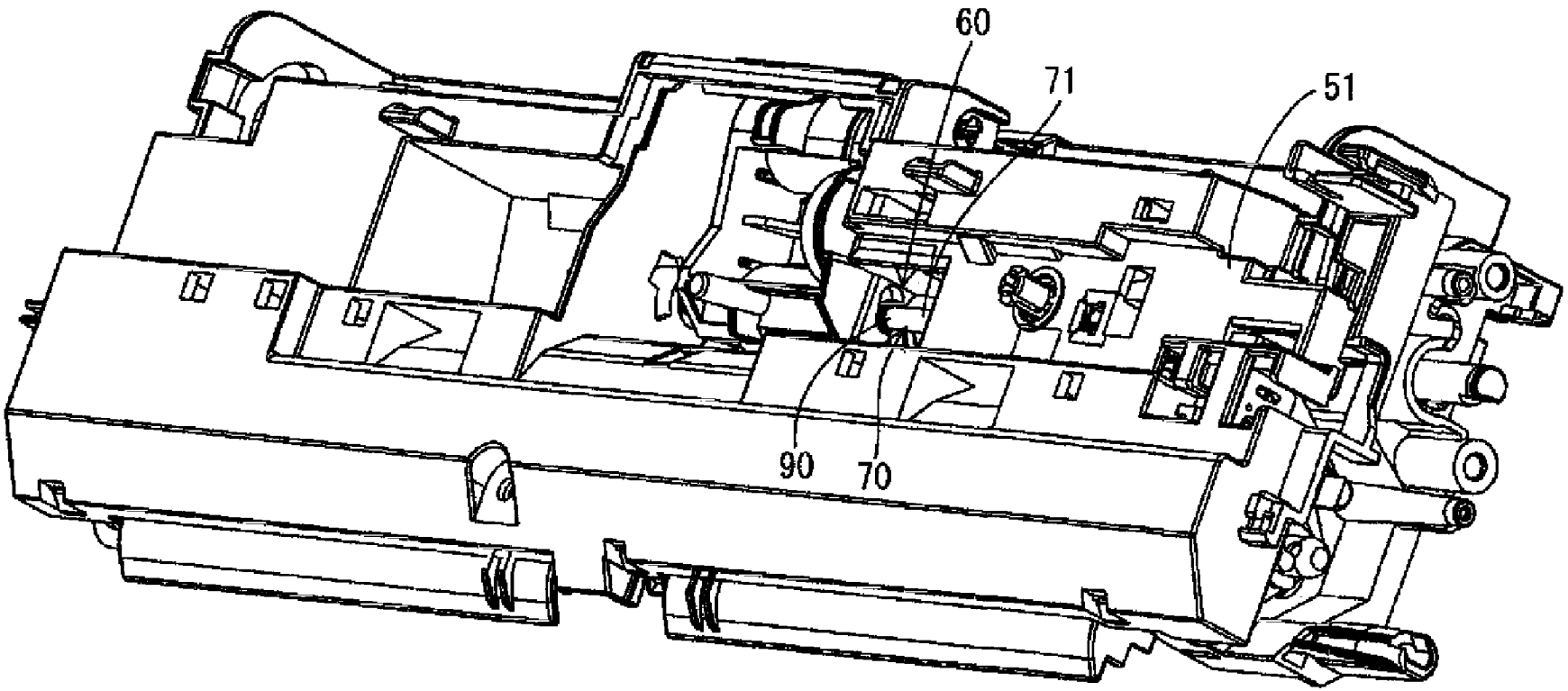
FIG. 2 is an oblique front above perspective view of a main portion around a recording medium sensor 60 in the laser printer 1.
Figure 3:
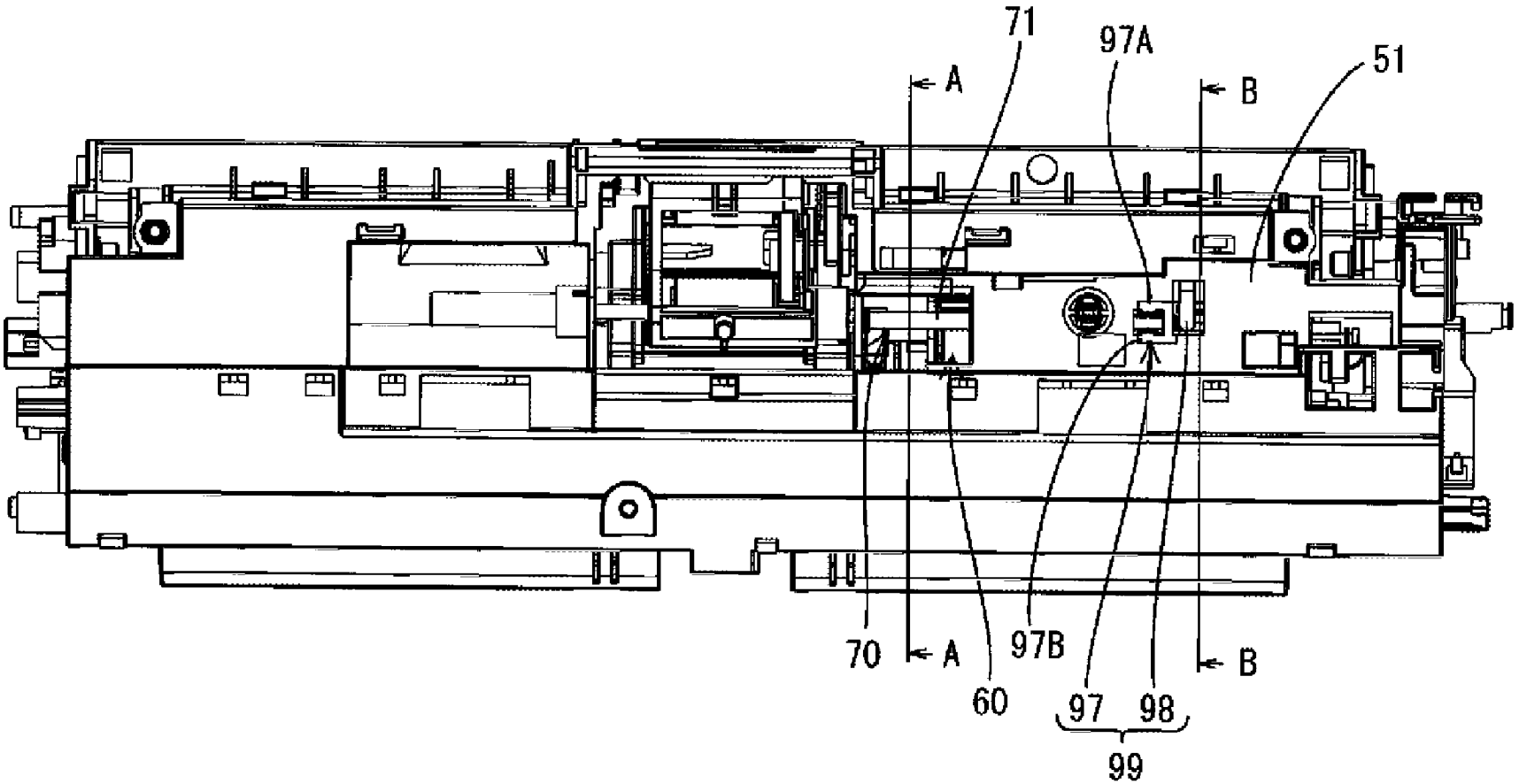
FIG. 3 is a top plan view of the main portion around the paper sheet sensor.
Figure 4:
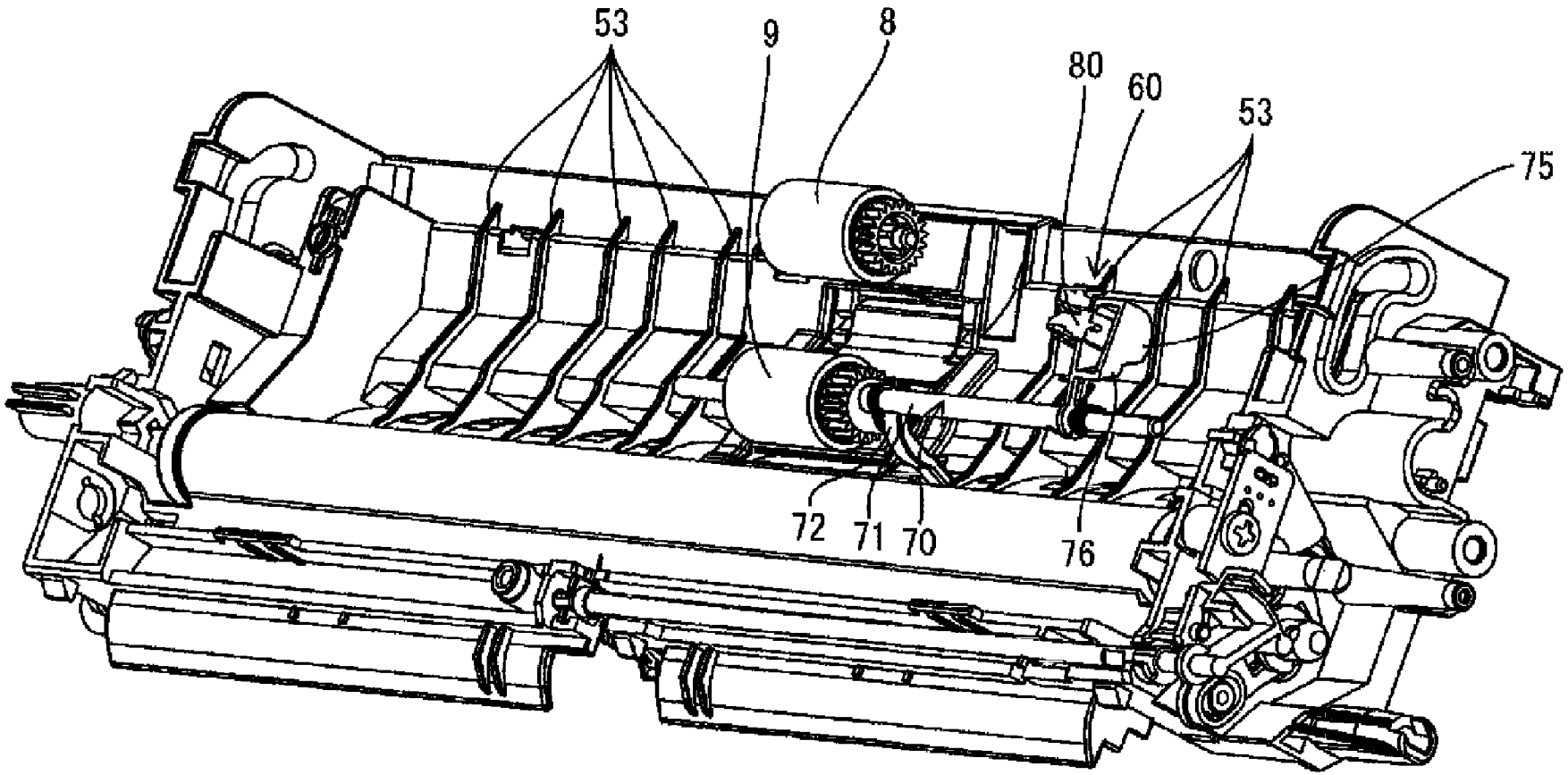
FIG. 4 is a perspective view showing a positional relation among a conveying roller, a resist roller, and the recording medium sensor.
Figure 5:
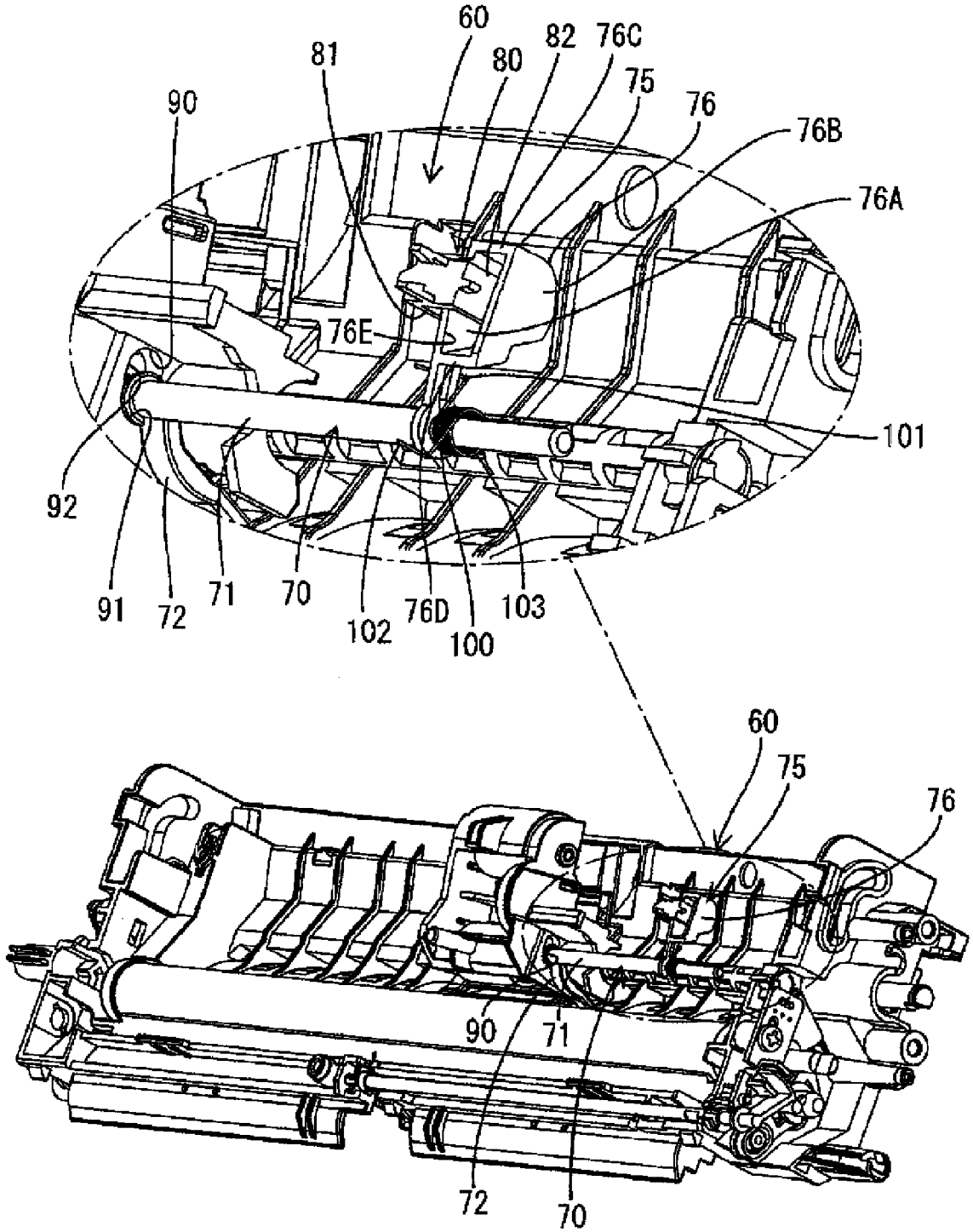
FIG. 5 is a perspective view showing a positional relation between the recording medium sensor and a shaft hole.
Figure 6:
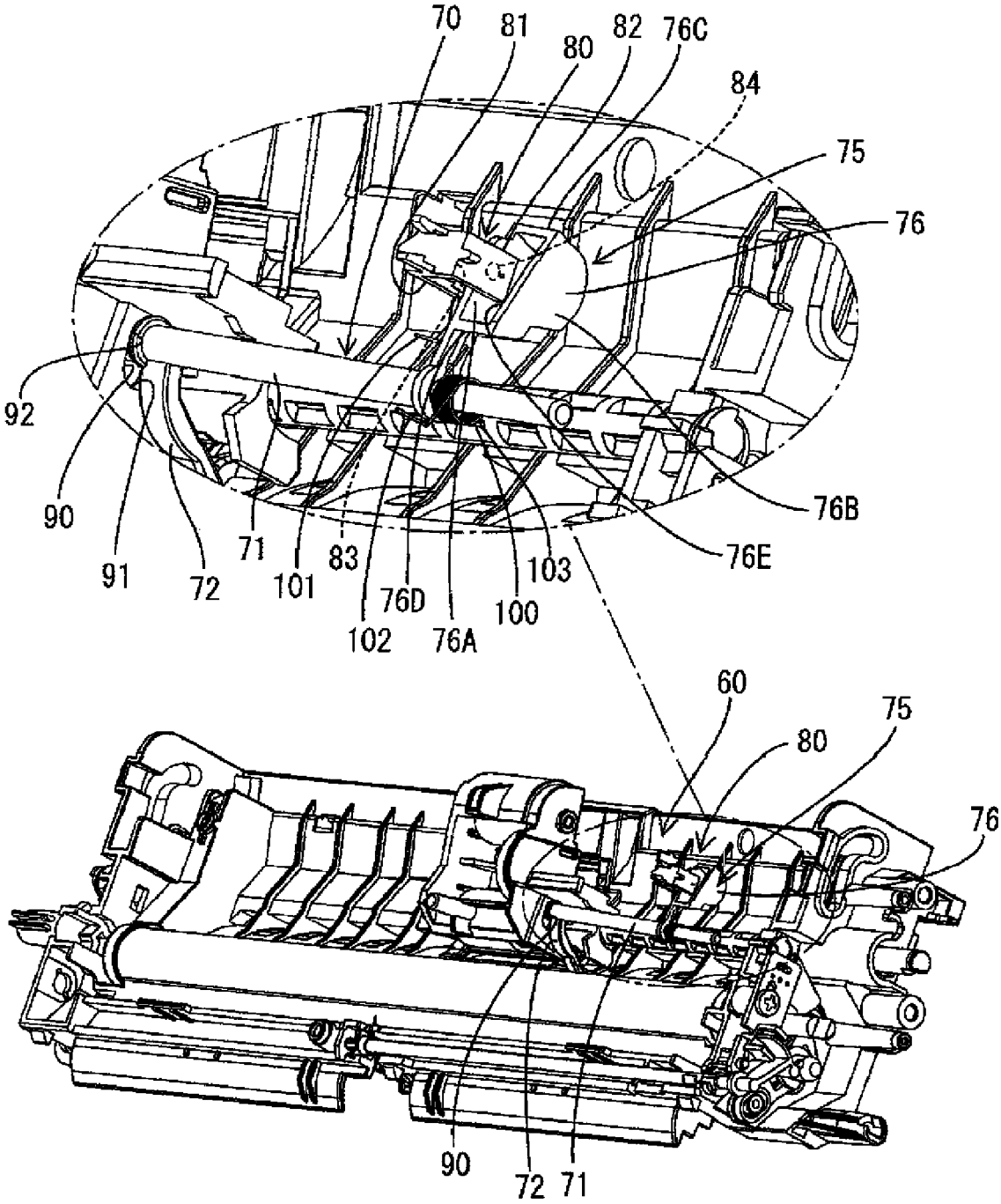
FIG. 6 is a perspective view showing a state in which a support shaft moved from a state shown in FIG. 5 to a retracting position.
Figure 7:
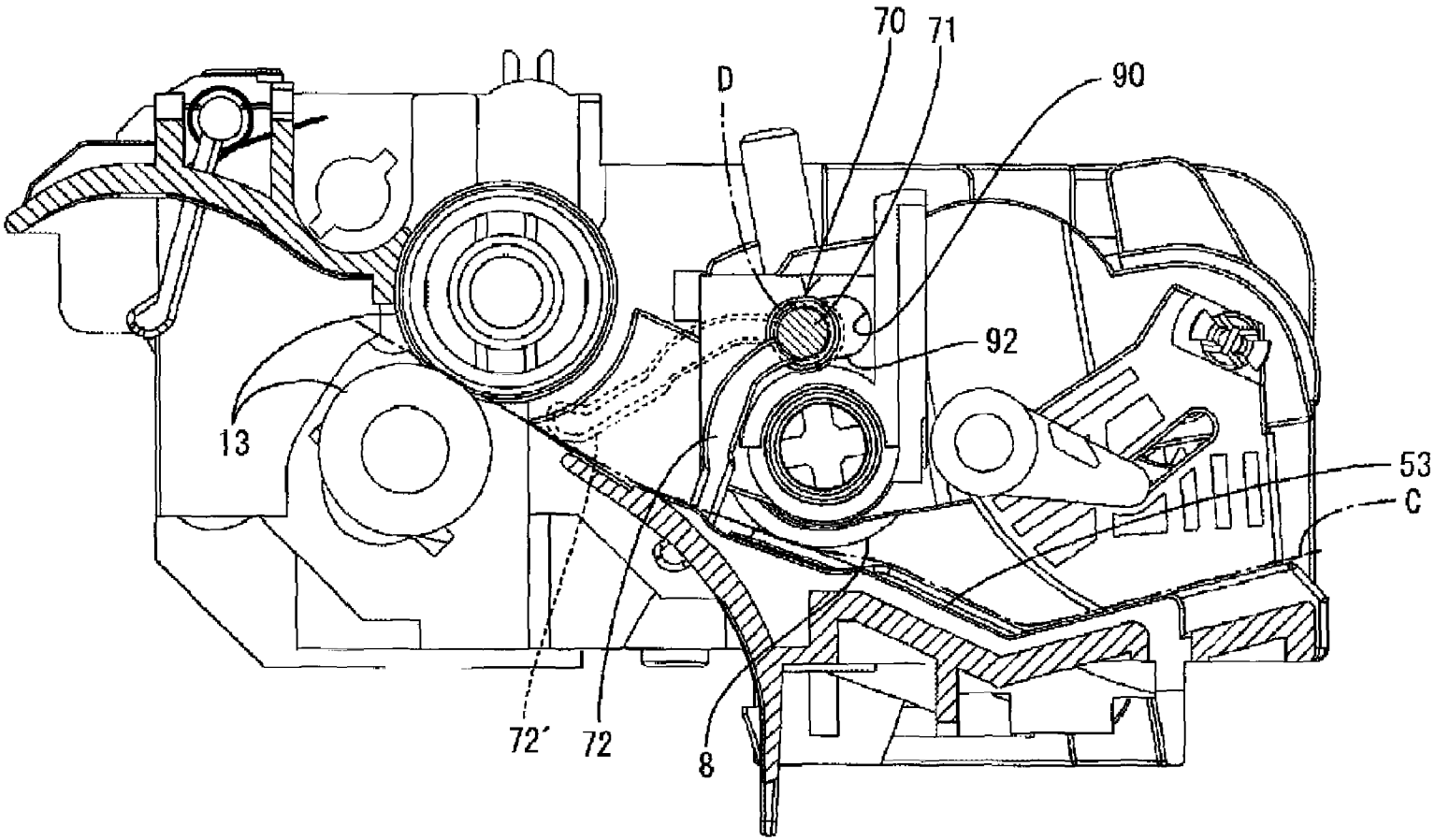
FIG. 7 is a schematic cross section viewed along arrows A-A in FIG. 3.
Figure 8:
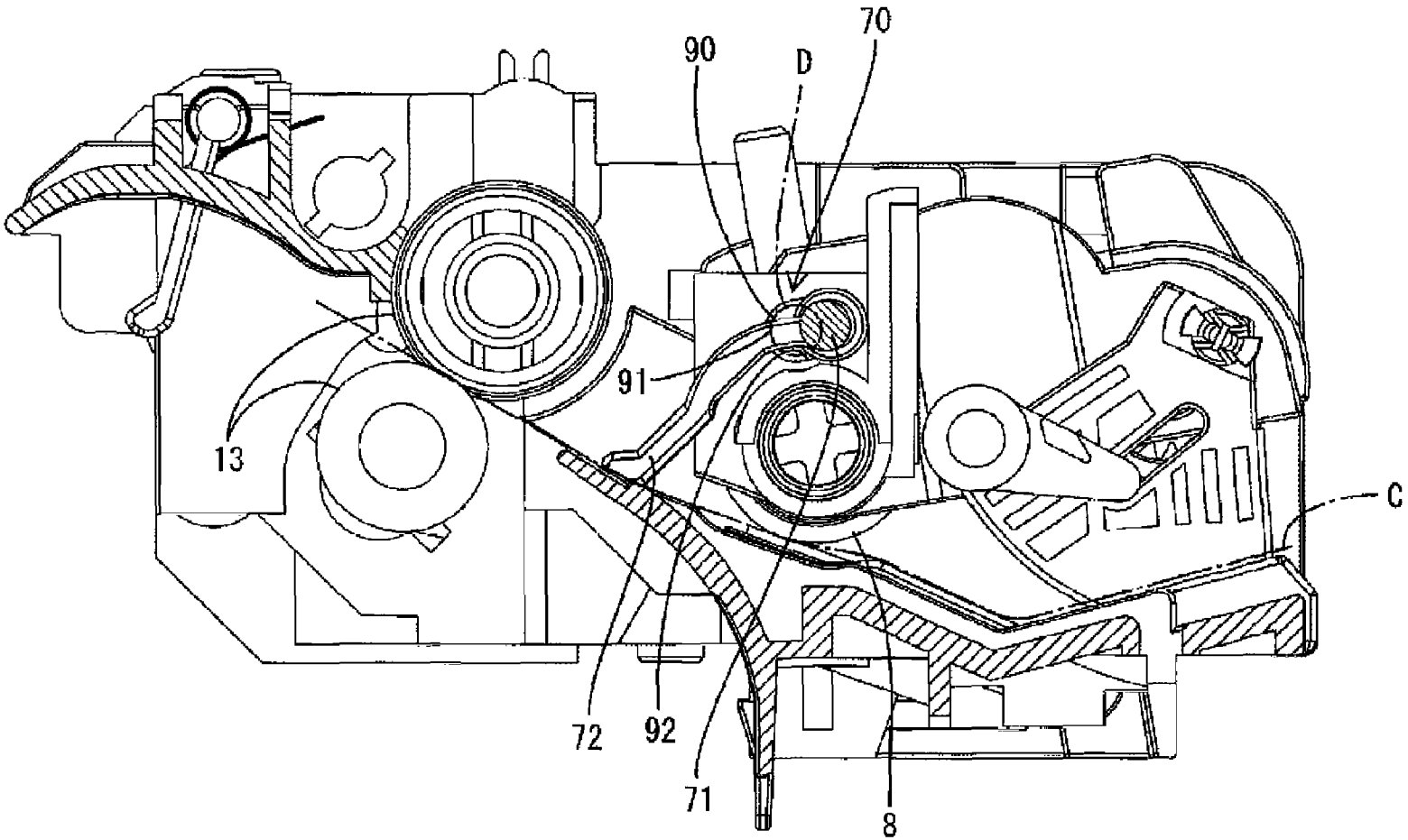
FIG. 8 is a sectional view showing a state in which the support shaft moved from a state shown in FIG. 7 to the retracting position.
Figure 9:
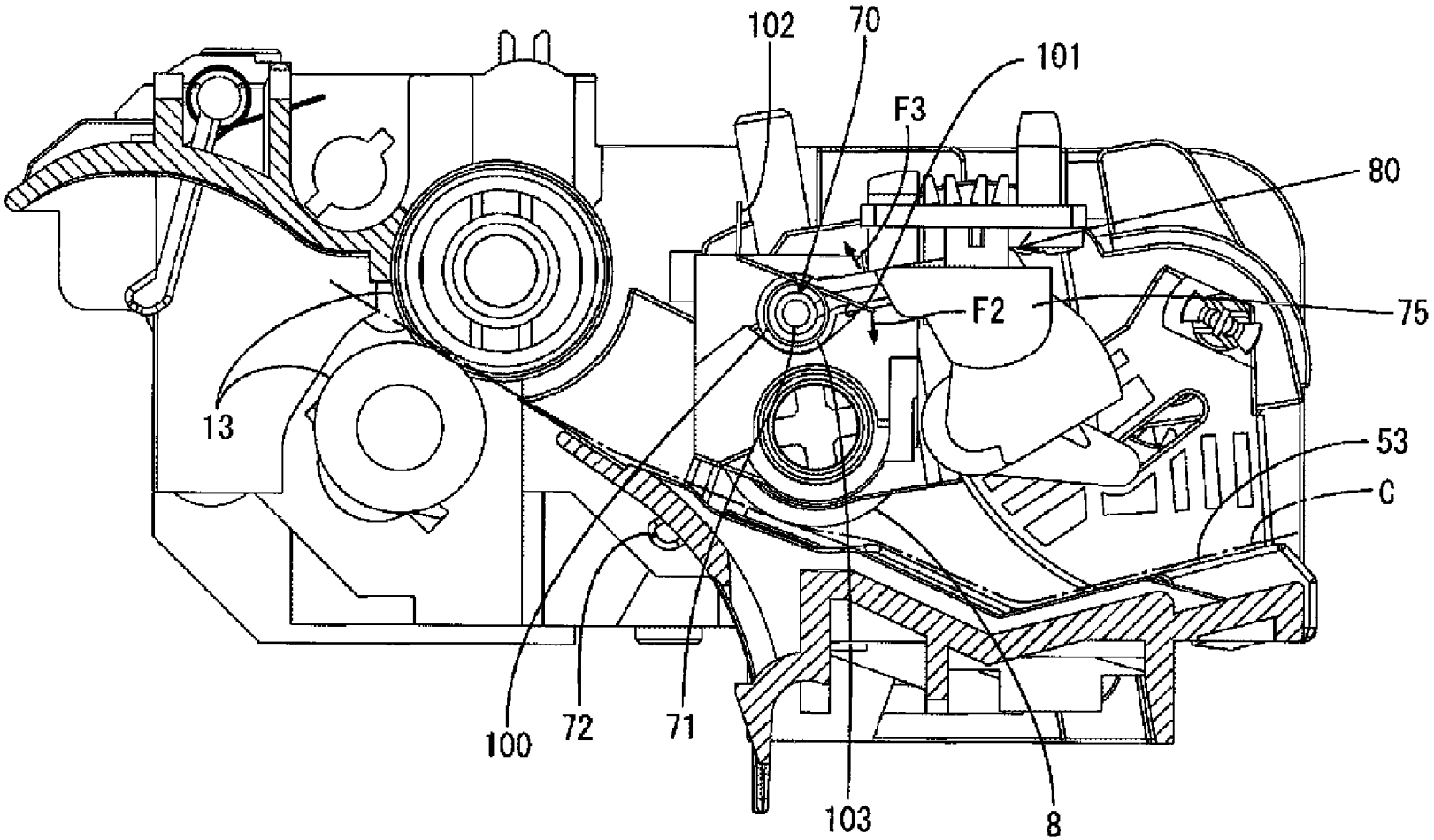
FIG. 9 is a schematic cross section viewed along arrows B-B in FIG. 3.

FIG. 2 is a perspective view of the main portion around a recording medium sensor 60 in the laser printer 1 viewed from oblique front above. FIG. 3 is a top plan view of the main portion around the recording medium sensor 60 viewed from above. FIG. 4 is a perspective view of a schematic internal configuration of the main portion shown in FIG. 2 for explaining a positional relation among conveying rollers 8, 9, and the recording medium sensor 60. FIG. 5 is a perspective view showing a positional relation between a recording medium sensor 60 and a support shaft 71. FIG. 6 is a perspective view showing a state in which the support shaft 71 moved from a state shown in FIG. 5 to a retracting position. FIG. 7 is a schematic cross section viewed along arrows A-A in FIG. 3. FIG. 8 is a sectional view showing a state in which the support shaft 71 moved from a state shown in FIG. 7 to the retracting position. FIG. 9 is a schematic cross section viewed along arrows B-B in FIG. 3.

As shown in FIG. 1, the laser printer 1 in accordance with this illustrative aspect has a recording medium sensor 60 in a position adjacent to the aforementioned conveying roller 8. As shown in FIGS. 2 to 4, this recording medium sensor 60 is held and partially covered by an internal frame 51 located inside the laser printer 1.

The recording medium sensor 60 is provided with a support shaft 71. As shown in FIG. 5, the support shaft 71 is located perpendicular to the direction of conveying a recording medium 4 and extends in a width direction of the printer, with one end side being inserted into a shaft hole 90 formed in a part of the internal frame 51 and the other end side supported by a rocking support portion 99 (FIG. 3) formed in the internal frame 51 described later. As shown, shaft hole 90 can have a long or oblong type shape to accommodate movement of the support shaft. A sensing arm 72, which is a medium sensing member, is fixed near one end portion of the support shaft 71 in a form extending in a radial direction of the support shaft 71. The thickness size of a tip portion of the sensing arm 72 can be smaller than the external size of the support shaft 71.

As shown in FIGS. 1, 4, and 7, the tip end of the sensing arm 72 can enter a conveyance path C of a recording medium 4 at a downstream side of the conveying roller 9. The conveyance path C of a recording medium 4 is defined as a path guided by the tip surface of a guide rib 53 abutted against the internal frame 51 in the vicinity of this recording medium sensor 60. It should be noted that as shown in FIG. 5, this support shaft 71 is biased by a torsion coil spring 100 (described later) to be held in a position (herein after referred to as a medium sensing position) supported at a side near the conveyance path C of a recording medium 4 inside the shaft hole 90.

As shown in FIG. 7, while the support shaft 71 is in a medium sensing position D, the sensing arm 72 is rotatable between a standby position (refer to a solid line in FIG. 7) in which a tip portion of the sensing arm 72 is placed on a conveyance path C of a recording medium 4, and a detection position (refer to a broken line in FIG. 7) to which the tip portion is retracted from the conveyance path C.

It is preferable that the position of the tip portion (contacting a recording medium 4) of the sensing arm 72 in the standby position should be arranged in the direction of conveying a recording medium 4 further downstream than an intersection point between a vertical line through the center of the support shaft 71 and the conveyance path C. This configuration allows the sensing arm 72 to be pushed and rotated smoothly as a recording medium 4 is conveyed.

The longitudinal direction of the shaft hole 90 is inclined toward the conveyance path C, allowing the support shaft 71 to move from the medium sensing position D to a retracting position away from the conveyance path C. When the support shaft 71 moves from the medium sensing position D to the retracting position, a pair of surfaces 92 extending along the longitudinal direction of the shaft hole 90 and facing with each other serves as a guide surface. The extending direction of a surface 92 (longitudinal direction of the shaft hole 90) is along a line connecting the tip portion of the sensing arm 72 and the center of the support shaft 71 when the sensing arm 72 is pushed by the recording medium 4 and reaches the sensing position.

On the other hand, the other end portion of the support shaft 71 (portion at a side opposite to a side supported by the shaft hole 90) is supported by a rocking support portion 99. The rocking support portion 99 is provided with a peripheral surface support portion 97 consisting of a pair of opposing walls 97A and 97B located inside the internal frame 51. Both opposing walls 97A and 97B are spaced at an interval a little longer than the external size of the support shaft 71, are protruded extending in a direction perpendicular to the axial direction of the support shaft 71, and movably hold the support shaft 71 between the opposing walls 97A and 97B. In addition, the rocking support portion 99 is further provided with an end face contact portion 98 for preventing the support shaft 71 from slipping out of the shaft hole 90 when the support shaft 71 moves along the axial direction which may allow the support shaft 71 from slipping out of the shaft hole 90 and an end face of the support shaft 71 may contact.

When a support shaft 71 is placed between the opposing walls 97A and 97B in the peripheral surface support portion 97, the distance between the opposing walls 97A and 97B is made a little larger than the outside diameter of the support shaft 71 enough to allow a portion at a first end side of the support shaft 71 to move between a first end portion of the shaft hole 90 (end portion at the support area D in a groove direction of a guide groove 92) and a second end portion (end portion opposite to the support area D in a groove direction of a guide groove 92). It should be noted that the aforementioned configuration of the rocking support portion 99 is just an example and is not limited to this, provided that a portion at a first end side of the support shaft 71 can move inside the shaft hole 90 and a second end portion is supported. For example, the rocking support portion 99 may be configured with a shaft bearing having an inside diameter a little larger than the outside diameter of the support shaft 71.

As shown in FIGS. 5 and 6, a rotation detection device 80 is provided to detect a rotation of the sensing arm 72 as described below. Projecting walls 81 and 82 are formed in pairs integral to the internal frame 51 (not shown in FIGS. 5 and 6). A light-emitting element 83 is located on the projecting wall 81 and a light receiving element 84 is located on the projecting wall 82. There is a light path in which light travels from the light-emitting element 83 to the light receiving element 84.

A pivoting arm 75 is fixed to the support shaft 71 in a form extending in a radial direction of the support shaft 71. As the support shaft 71 is rotated, the pivoting arm 75 is integrally pivoted. A light blocking box 76 is formed integral to a tip of the pivoting arm 75. The light blocking box 76 is formed like a box having an opening portion 76E located opposite to the conveyance path C of a recording medium 4. A wall face of the light blocking box 76 is located between the aforementioned projecting walls 81 and 82 such that the projecting wall 82 may enter the light blocking box 76.

In a state of the support shaft 71 in which the sensing arm 72 is in a standby state, the projecting wall 82 is located inside the light blocking box 76 as shown in FIG. 5. As a result, the light path between the light-emitting element 83 and the light receiving element 84 is blocked by a wall of the light blocking box 76. When the sensing arm 72 is pushed by a recording medium 4 and rotated, the pivoting arm 75 is pivoted accordingly. When the sensing arm 72 is rotated to reach the detection position, the projecting wall 82 is outside the light blocking box 76. As a result, the light path between the light-emitting element 83 and the light receiving element 84 is opened, and then light from the light-emitting element 83 reaches the light receiving element 84. Therefore, when the light receiving element 84 receives light from the light-emitting element 83, a recording medium 4 is detected by the recording medium sensor 60; while the light receiving element 84 does not receive light from the light-emitting element 83, a recording medium 4 is not detected by the recording medium sensor 60.

An opening portion 76E is formed on only one face of the light blocking box 76. When the projecting wall 82 enters the light blocking box 76, the light receiving element 84 is enclosed by four walls 76A, 76B, 76C, and 76D. Accordingly, not only light from the light-emitting element 83 but also other external light cannot easily enter the light receiving element 84, and thus detection errors can be prevented.

A recording medium sensor 60 in accordance with this illustrative aspect is provided with a torsion coil spring 100 mounted on the support shaft 71 as shown in FIGS. 5 and 9. This torsion coil spring 100 has a form extending locking portions 101 and 102 of both ends of a coil portion 103. The locking portion 101 at a first end side is engaged with the downside (conveyance path C side) of the pivoting arm 75 as shown in FIG. 9. Also, the locking portion 102, at a second end side, is connected to a specified portion of the frame (not shown). This biases the torsion coil spring 100 and the pivoting arm 75 to rotate counterclockwise around the support shaft 71 as shown in FIG. 9. As a result, the sensing arm 72 is normally biased toward a standby portion, i.e., in a direction of the pivoting arm 75 allowing the light blocking box 76 to block the light path between the light-emitting element 83 and the light receiving element 84.

When the support shaft 71 moves from the medium sensing position (shown in FIG. 5) to the retracting position (shown in FIG. 6), i.e., when an end of the support shaft 71 moves from a support area D inside the shaft hole 90 to a position opposite to the conveyance path C, the support shaft 71 is inclined as shown in FIG. 6. As a result, the coil portion 103 is twisted together with the support shaft 71. An elastic biasing force exerted from the locking portion 102 of the torsion coil spring 100 exerts a restoring force which causes the support shaft 71 to move back into the medium sensing position (shown in FIG. 5).

As described above, in the laser printer 1 in accordance with this illustrative aspect, the torsion coil spring 100 allows the support shaft 71 of the sensing arm 72 to be normally biased to the medium sensing position, and the support shaft 71 can move from the medium sensing position to the retracting position.

For example, when a recording medium 4 contacts the sensing arm 72, and jamming occurs with the sensing arm 72 being in a position shown by a broken line 72' in FIG. 7, a user may try to pull out a recording medium 4 forcibly in a direction opposite to the conveying direction. Upon this action, the recording medium 4 pushes the sensing arm 72 toward the support shaft 71, which then moves to the retracting position along the shaft hole 90. As a result, the likelihood of recording medium 4 becoming stuck with the sensing arm 72 is reduced or prevented, which allows for the recording medium 4 to be easily pulled and/or removed. Accordingly, the recording medium 4 can also be prevented from being broken and/or torn apart inside the printer.

In this illustrative aspect as described above, the support shaft 71 supporting the sensing arm 72 is retracted to a retracting position along the shaft hole 90 to keep the sensing arm 72 out of the way to facilitate removing a jammed recording medium 4. This structure can be formed of a small number of components and at a lower cost.

In this illustrative aspect, a first end side of the support shaft 71 is supported by the shaft hole 90, and a second end side of the support shaft 71 is supported by the rocking support portion 99. When the support shaft 71 is retracted to the retracting position, the support shaft 71 is pivotally rotated a little around the rocking support portion 99 side. In other word, when the support shaft 71 is moved from the medium sensing position to the retracting position, the support shaft 71 is configured to be inclined. The sensing arm 72, able press-contact the recording medium 4, is located near a first end portion (inserted into the shaft hole 90) of the support shaft 71, and the pivoting arm 75 is located near a second end portion (rocking support portion 99 side) of the support shaft 71 to detect a rotation of the support shaft 71. Therefore, even if a first end portion of the support shaft 71 is retracted to the retracting position and the support shaft 71 is inclined, the amount of displacement of the pivoting arm 75 caused by this movement is less than that of the pivoting arm 75 located near a first end portion of the support shaft 71. Accordingly, the rotation detection device 80 need not be formed as a special structure, and it is possible to maintain an appropriate positional relation between rotation detection device 80 and the pivoting arm 75, thus assuring an appropriate detection of a recording medium 4.

The laser printer 1 in accordance with this illustrative aspect is provided with a torsion coil spring 100 as a biasing means for biasing the support shaft 71 toward the medium sensing position. This assures that when a recording medium 4 is conveyed, the support shaft 71 can be stably held in the medium sensing position, thereby improving the sensing accuracy of the recording medium 4.

In addition, when the support shaft 71 is in the medium sensing position, the sensing arm 72 is pushed to a detection position. After the recording medium 4 is passed, this torsion coil spring 100 also has a function to bias the sensing arm 72 to return to the standby position. This structure enables the sensing arm 72 to be stably held in the standby position when no paper sheet is detected, and thus the sensing arm 72 cannot easily enter an unstable state, thereby assuring the detection of the recording medium 4 with a high accuracy.

The sensing arm 72 is configured to extend in a direction crossing the support shaft 71 and the tip portion of the sensing arm 72 is formed thinner than the shaft diameter of the support shaft 71. This allows the sensing arm 72 to be compact and light weight. It should be noted that the thinner the tip portion of the sensing arm 72, the more likely the recording medium 4 is to be broken during jamming. With this in mind, the support shaft 71 is configured to be retracted to the standby position by the shaft hole 90, thereby preventing the recording medium 4 from being stuck and broken.

<Another Illustrative Aspect>

The present invention is not limited to the illustrative aspect as described above and shown in the above drawings. For example, the technical scope of the present invention includes another illustrative aspect described below.

(1) In the above illustrative aspect, the support shaft 71 rotates integrally when the sensing arm 72 rotates. However, without being limited to this, the sensing arm 72 is rotatably configured to the support shaft 71; and for example, a light blocking member may be mounted integrally on the sensing arm 72 to directly detect the rotation of the sensing arm 72.

(2) In the above illustrative aspect, the support shaft 71 is held in the medium sensing position by a bias of the torsion coil spring 100 when the recording medium 4 is conveyed. However, without being limited to this, the support shaft 71 may be held in the medium sensing position by the weight of a support shaft and other parts (such as the pivoting arm 75, the sensing arm 72 and the like) mounted on the support shaft.

(3) In the above illustrative aspect, the support shaft 71 is retractably guided to the retracting position by supporting the support shaft 71 by the shaft hole 90. However, without being limited to this, the support shaft may be retractably guided to the retracting position by supporting the support shaft by a shaft bearing, and guide-movably supporting the shaft bearing.

(4) The present invention can be applied to not only an electrophotographic color laser printer illustrated in the above illustrative aspect, but also another image forming apparatus such as a monochrome printer, an inkjet printer and other printers using different printing systems as well as a multifunction apparatus having a facsimile function and a copying function and the like.

(5) In the above illustrative aspect, the support shaft 71 for detecting the paper sheet, the sensing arm 72, and the pivoting arm 75 are located near the conveying roller 8 to be used for manual feeding. However, not only this position, but also any other position (such as near the fixing device or the discharge roller) may be selected as long as the position is near the conveyance path of the recording medium.

What is claimed is:

1. An image forming apparatus comprising:

a conveying device configured to convey a recording medium;

a support shaft which is configured to be movably supported between a medium sensing position near a conveyance path along which the conveying device conveys the recording medium and a retracting position away from the medium sensing position, wherein the support shaft is biased to the medium sensing position;

a medium sensing member connected to the support shaft and configured to rotate between a standby position wherein a portion of the medium sensing member is in the conveyance path and a detection position wherein the portion of the medium sensing member is removed from the conveyance path by the recording medium passing along the conveyance path when the support shaft is in the medium sensing position; and a rotation detection device configured to detect a rotational displacement of the medium sensing member, wherein at least a first end portion of the support shaft is supported by and laterally movable within a shaft hole and the support shaft is movable between the medium sensing position and the retracting position.

2. The image forming apparatus according to claim 1, wherein the medium sensing member is fixed to the support shaft and the support shaft is rotated integrally with the medium sensing member by rotating the medium sensing member between the standby position and the detection position.

3. The image forming apparatus according to claim 2, wherein the rotation detection device includes a pivoting arm connected to the support shaft and a light-emitting element and a light receiving element configured to detect a rotational displacement of the pivoting arm by blocking and unblocking a light path.

4. The image forming apparatus according to claim 1, wherein the first end portion of the support shaft is configured to move between the medium sensing position and the retracting position, further wherein a second end portion of the support shaft is supported to be able to be inclined, and the medium sensing member is adjacent to the first end portion of the support shaft, and a pivoting arm is adjacent to the second end portion of the support shaft.

5. The image forming apparatus according to claim 1, wherein the support shaft is biased in the medium sensing position by its own weight.

6. The image forming apparatus according to claim 1, further including a spring for biasing the support shaft in the medium sensing position.

7. The image forming apparatus according to claim 1, further including a spring for biasing the medium sensing member in the standby position.

8. The image forming apparatus according to claim 4, wherein a torsion coil spring is connected to the support shaft, a first end of the torsion coil spring is engaged with the medium sensing member, and a second end of the torsion coil spring is engaged with a portion other than the support shaft of the image forming apparatus.

9. The image forming apparatus according to claim 4, wherein the medium sensing member is an arm extending in a radial direction from the support shaft, and a tip portion is thinner than a diameter of the support shaft.

10. An image forming apparatus comprising:

a conveying device configured to support a conveyance path of a recording medium;

a support shaft configured to be movably supported between a medium sensing position near the conveyance path and a retracting position away from the medium sensing position, wherein the support shaft is biased to the medium sensing position;

a medium sensing member connected to the support shaft and configured to rotate between a standby position wherein a portion of the medium sensing member is in the conveyance path and a detection position wherein the portion of the medium sensing member is out of the conveyance path because of the recording medium passing along the conveyance path when the support shaft is in the medium sensing position; and a rotation detection device configured to detect a rotational displacement of the medium sensing member, wherein a first end portion of the support shaft is positioned in a shaft hole and laterally movable within the shaft hole.

11. The image forming apparatus according to claim 10, wherein the medium sensing member is fixed to the support shaft and the support shaft is configured to rotate the medium sensing member between the standby position and the detection position.

12. The image forming apparatus according to claim 11, wherein the rotation detection device includes a pivoting arm connected to the support shaft and a light-emitting element and a light receiving element configured to detect a rotational displacement of the pivoting arm by blocking and unblocking a light path.

13. The image forming apparatus according to claim 10, wherein the first end portion of the support shaft enables the moving of the support shaft between the medium sensing position and the retracting position.

14. The image forming apparatus according to claim 13, wherein the support shaft includes a second end portion, further wherein the second end portion is able to be inclined.

15. The image forming apparatus according to claim 14, wherein the medium sensing member is adjacent to the first end portion of the support shaft, and a pivoting arm is adjacent to the second end portion of the support shaft.

16. The image forming apparatus according to claim 10, further including a spring for biasing the support shaft in at least one of the medium sensing position and the standby position.

17. The image forming apparatus according to claim 15, wherein a torsion coil spring is connected to the support shaft, a first end of the torsion coil spring is engaged with the medium sensing member, and a second end of the torsion coil spring is engaged with a portion other than the support shaft.

18. The image forming apparatus according to claim 15, wherein the medium sensing member extends from the support shaft in a generally curved shape, and a tip portion of the medium sensing member is thinner than a diameter of the support shaft.

* * * * *